US010006694B2

(12) United States Patent
Zhang et al.

(10) Patent No.: US 10,006,694 B2
(45) Date of Patent: Jun. 26, 2018

(54) REFRIGERATOR

(71) Applicants: HEFEI HUALING CO., LTD., Hefei (CN); HEFEI MIDEA REFRIGERATOR CO., LTD., Hefei (CN)

(72) Inventors: Wei Zhang, Hefei (CN); Xiuhua Geng, Hefei (CN); Jun Yao, Hefei (CN); Hao Chen, Hefei (CN)

(73) Assignees: HEFEI HUALING CO., LTD., Hefei (CN); HEFEI MIDEA REFRIGERATOR CO., LTD., Hefei (CN)

( * ) Notice: Subject to any disclaimer, the term of this patent is extended or adjusted under 35 U.S.C. 154(b) by 0 days. days.

(21) Appl. No.: 15/315,419

(22) PCT Filed: Jan. 15, 2015

(86) PCT No.: PCT/CN2015/070744

§ 371 (c)(1),
(2) Date: Dec. 1, 2016

(87) PCT Pub. No.: WO2015/184808

PCT Pub. Date: Dec. 10, 2015

(65) Prior Publication Data

US 2017/0108270 A1 Apr. 20, 2017

(30) Foreign Application Priority Data

Jun. 3, 2014 (CN) ..... 2014 1 0242913

(51) Int. Cl.
*F25D 25/02* (2006.01)
*F25D 31/00* (2006.01)
(Continued)

(52) U.S. Cl.
CPC ..... *F25D 31/007* (2013.01); *F25D 11/00* (2013.01); *F25D 23/066* (2013.01);
(Continued)

(58) Field of Classification Search
CPC ..... F25D 31/00; F25D 23/067; F25D 25/02; F25D 2331/803; F25D 2303/0841;
(Continued)

(56) References Cited

U.S. PATENT DOCUMENTS 2,005,939 A * 6/1935 Hibbard, Jr. ..... F25D 25/02 211/113
2,104,939 A * 1/1938 Whalen ..... F25D 25/027 312/300
(Continued)

FOREIGN PATENT DOCUMENTS

CN 201757561 U 3/2011
CN 201757562 U 3/2011
(Continued)

OTHER PUBLICATIONS

ISA/CN, International Search Report for PCT/CN2015/070744 dated Apr. 16, 2015.

*Primary Examiner* — Hiwot E Tefera
(74) *Attorney, Agent, or Firm* — Hodgson Russ LLP

(57) ABSTRACT

A refrigerator (100) includes a liner (10) forming a refrigeration compartment (101); a wine rack (20) having a bottle placing portion (21) and an end being connected to a side wall of the refrigeration compartment (101) and pivoting about an axis in an up-down direction, in which the wine rack is capable of shifting between a first position where the wine rack abuts against to the side wall and a second position where the wine rack is perpendicular to the side wall; and an auxiliary bracket (30) being connected to a rear side wall of the refrigeration compartment (101) and opposite to the bottle placing portion (21). The wine rack of the refrigerator occupies a small space in a refrigeration compartment when not in use.

12 Claims, 4 Drawing Sheets

(51) Int. Cl.
*F25D 11/00* (2006.01)
*F25D 23/06* (2006.01)

(52) U.S. Cl.
CPC ..... *F25D 23/067* (2013.01); *F25D 25/02* (2013.01); *F25D 2331/803* (2013.01)

(58) Field of Classification Search
CPC ..... F25D 23/04; F25D 2325/021; F25D 2325/023; F25D 2331/812; F25D 2331/809; F25D 2331/805; F25D 25/00; F25D 23/066; F25D 11/00
USPC ..... 312/408, 404, 351, 405.1, 406
See application file for complete search history.

(56) References Cited

U.S. PATENT DOCUMENTS 4,944,477 A * 7/1990 Hendren ..... A47F 7/28 248/150
5,685,624 A * 11/1997 Lee ..... F25D 23/04 312/274
8,132,871 B1 * 3/2012 Caruso ..... A47B 73/002 211/169
2005/0258118 A1 * 11/2005 Lee ..... A47B 55/02 211/134
2006/0266905 A1 * 11/2006 Becke ..... F25D 25/021 248/302
2009/0026162 A1 * 1/2009 Kwon ..... F25D 25/02 211/144

FOREIGN PATENT DOCUMENTS

| | | | |
|---|---|---|---|
| CN | 102353225 | A | 2/2012 |
| CN | 102564038 | A | 7/2012 |
| CN | 203163408 | | 8/2013 |
| CN | 203163408 | U | 8/2013 |
| CN | 103335483 | | 10/2013 |
| CN | 103423953 | | 12/2013 |
| EP | 2184570 | | 5/2010 |
| EP | 2292996 | | 3/2011 |
| KR | 20070062845 | A | 6/2007 |
| WO | 2007054916 | | 5/2007 |

* cited by examiner

REFRIGERATOR

CROSS-REFERENCE TO RELATED APPLICATIONS

The present application is a national phase entry under 35 USC § 371 of International Application No. PCT/CN2015/070744, filed Jan. 15, 2015, which claims the benefit of and priority to Chinese Patent Application No. 201410242913.4, filed Jun. 3, 2014, the entire disclosures of which are incorporated herein by reference.

FIELD

The present disclosure relates to refrigeration equipment, and more particularly to a refrigerator.

BACKGROUND

In the related art, a usual wine rack in a refrigerator is independent part, and the wine rack occupies space in a refrigeration compartment if the wine rack is not taken off when not in use.

SUMMARY

Embodiments of the present disclosure seek to solve at least one of the problems existing in the related art to at least some extent. One objective of the present disclosure is to provide a refrigerator, and a wine rack of the refrigerator occupies a small space in a refrigeration compartment when not in use.

A refrigerator according to an embodiment of the present disclosure, includes: a liner forming a refrigeration compartment of the refrigerator; a wine rack having a bottle placing portion and an end being connected to a side wall of the refrigeration compartment and pivoting about an axis in an up-down direction, in which the wine rack is capable of shifting between a first position where the wine rack abuts against to the side wall and a second position where the wine rack being perpendicular to the side wall; and an auxiliary bracket being connected to a rear side wall of the refrigeration compartment and opposite to the bottle placing portion.

As to the refrigerator according to the embodiment of the present disclosure, the wine rack can shift between the first position and the second position, that is, the wine rack may be received at the first position when not in use for placing a wine bottle, it is needless to remove the wine rack from the refrigeration compartment, thus occupying small space in the refrigeration compartment and facilitating use.

Further the refrigerator according to the embodiment of the present disclosure may further have the following additional features.

According to an embodiment of the present disclosure, the refrigerator further includes a wine rack support, the wine rack support is disposed to the side wall, an upper end face of the wine rack support is provided with a first shaft hole, a lower end face of the wine rack support is provided with a second shaft hole corresponding to the first shaft hole, the wine rack support is made of a bended steel wire, and the end of the of the wine rack is provided with a first rotating shaft fitted with the first shaft hole and a second rotating shaft fitted with the second shaft hole.

According to an embodiment of the present disclosure, the upper end face of the wine rack support is provided with a limiting member, and the limiting member comprises a transversal limiting portion located in front of the first shaft hole and a longitudinal limiting portion extending backwards from an upper portion of the transversal limiting portion at a predetermined distance.

According to an embodiment of the present disclosure, the transversal limiting portion and the longitudinal limiting portion are integrated.

According to an embodiment of the present disclosure, the wine rack support has a hollow structure.

According to an embodiment of the present disclosure, the refrigerator further includes a pre-embedded member, the pre-embedded member being disposed at outside of the refrigeration compartment and corresponding to the wine rack support, and the pre-embedded member being connected to the wine rack support through a screw penetrating the side wall.

According to an embodiment of the present disclosure, the bottle placing portion is a first recess formed in the wine rack, and the auxiliary bracket has a second recess corresponding to the first recess.

According to an embodiment of the present disclosure, the auxiliary bracket is detachably connected to the liner.

According to an embodiment of the present disclosure, the auxiliary bracket is snapped to the liner.

According to an embodiment of the present disclosure, the auxiliary bracket is a plastic member.

Additional aspects and advantages of embodiments of present disclosure will be given in part in the following descriptions, become apparent in part from the following descriptions, or be learned from the practice of the embodiments of the present disclosure.

Figure 1:
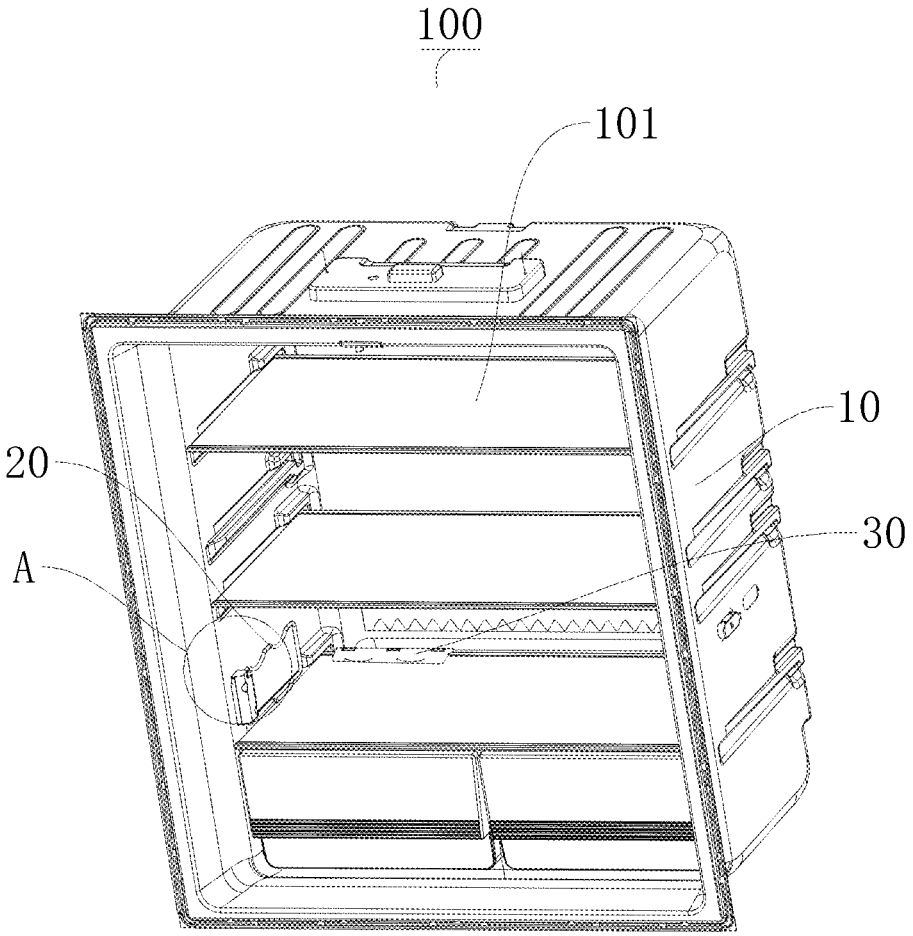
FIG. 1 is a schematic view of a refrigerator according to an embodiment of the present disclosure, in which a wine rack is located at a first position.

REFERENCE NUMERALS refrigerator 100;
liner 10;
refrigeration compartment 101;
wine rack 20;
bottle placing portion 21;
first rotating shaft 201;
second rotating shaft 202;
auxiliary bracket 30;
first recess 31;
wine rack support 40;
limiting member 41;
transverse limiting portion 411;
longitudinal limiting portion;
pre-embedded member 50.

DETAILED DESCRIPTION

Reference will be made in detail to embodiments of the present disclosure. The embodiments described herein with reference to drawings are explanatory, illustrative, and used to generally understand the present disclosure. The embodiments shall not be construed to limit the present disclosure. The same or similar elements and the elements having same or similar functions are denoted by like reference numerals throughout the descriptions.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not require that the present invention be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Figure 3:
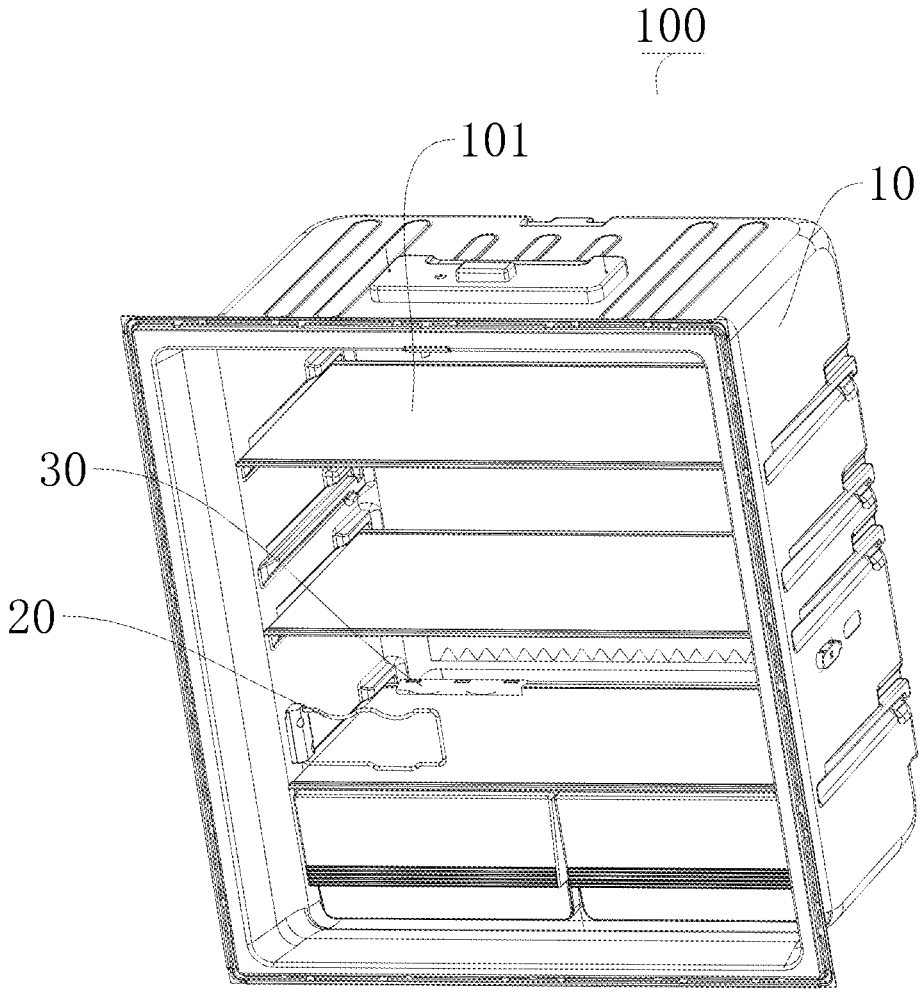
FIG. 3 is a schematic view of a refrigerator according to an embodiment of the present disclosure, in which a wine rack is located at a second position.

As shown in FIG. 1 and FIG. 3, a refrigerator 100 according to an embodiment of the present disclosure includes a liner 10, a wine rack 20 and an auxiliary bracket 30.

Specifically, the liner 10 forms a refrigeration compartment 101. For example, the refrigeration compartment 101 may be a refrigeration chamber of the refrigerator 100. The wine rack 20 has a bottle placing portion 21, an end of the wine rack is connected to a side wall of the refrigeration compartment 101 and can pivot about an axis in an up-down direction, and the wine rack is capable of shifting between a first position where the wine rack 20 abuts against to the side wall (as shown in FIG. 1) and a second position where the wine rack 20 is perpendicular to the side wall (as shown in FIG. 3). The auxiliary bracket 30 is connected to a rear side wall of the refrigeration compartment 101 and opposite to the bottle placing portion 21. In other words, the wine rack 20 may be fitted with the auxiliary bracket 30 to be used for placing a wine bottle when located at the second position, and the wine bottle may be placed on the wine rack 20 and the auxiliary support 30 in a front-rear direction.

As to the refrigerator according to an embodiment of the present disclosure, the wine rack 20 can shift between the first position and the second position, that is, the wine rack 20 may be received at the first position when not in use for placing a wine bottle, it is needless to remove the wine rack 20 from the refrigeration compartment 101, thus occupying small space in the refrigeration compartment 101 and facilitating use.

Figure 4:
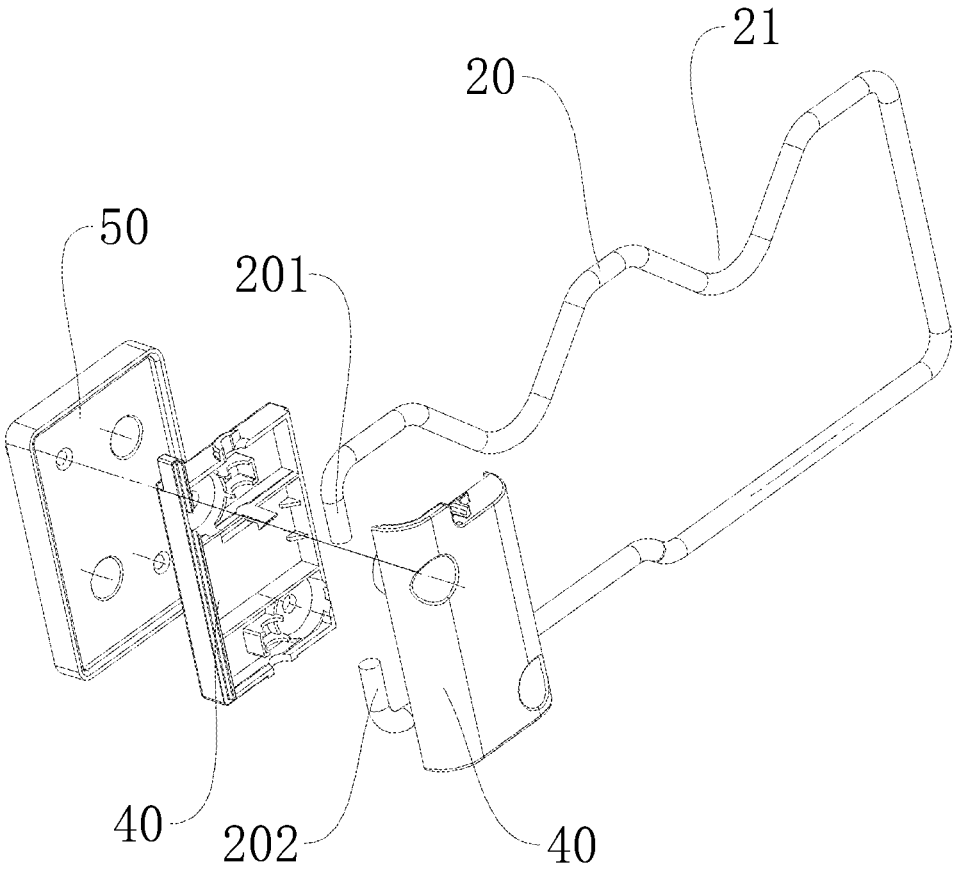
FIG. 4 is a schematic view showing relative positions of a wine rack, a wine rack support and a pre-embedded member of a refrigerator according to an embodiment of the present disclosure.

As shown in FIG. 4, according to an embodiment of the present disclosure, the refrigerator 100 may further include a wine rack support 40, and the wine rack support 40 is disposed to the side wall, for example, the wine rack support may protrude an internal side wall of the liner 10. An upper end face of the wine rack support 40 is provided with a first shaft hole (not shown), and a lower end face of the wine rack support 40 is provided with a second shaft hole (not shown) corresponding to the first shaft hole. The wine rack support 40 is made of a bended steel wire, and an end of the of the wine rack 20 is provided with a first rotating shaft 201 fitted with the first shaft hole and a second rotating shaft 202 fitted with the second shaft hole 202. Therefore, the wine rack 20 can be more firmly connected to the wine rack support 40, so as to more stably support a wine bottle.

Figure 2:
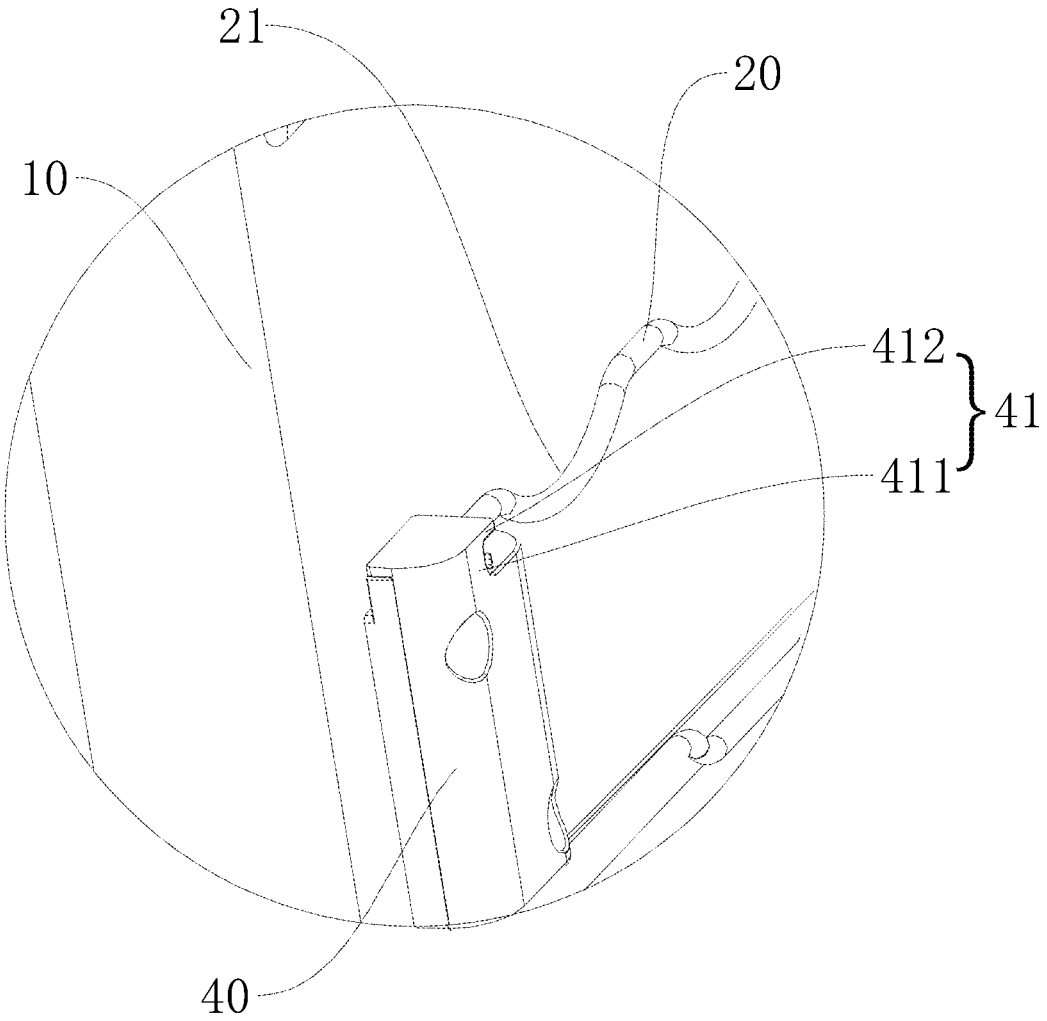
FIG. 2 is an enlarged view of part A in FIG. 1.

As shown in FIG. 2, according to an embodiment of the present disclosure, the upper end face of the wine rack support 40 is provided with a limiting member 41, and the limiting member 41 includes a transversal limiting portion 411 located in front of the first shaft hole and a longitudinal limiting portion 412 extending backwards from an upper portion of the transversal limiting portion 411 at a predetermined distance. Therefore, the transversal limiting portion 411 can be used for limiting a rotational angle of the wine rack 20 in a horizontal direction, and the longitudinal limiting portion 412 can be used for limiting a position of the wine rack 20 in an up-down direction, to prevent the wine rack 20 from falling off from the wine rack support 40 accidently. Furthermore, according to an embodiment of the present disclosure, the transversal limiting portion 411 and the longitudinal limiting portion 412 are integrated. In order to make a production cost low, the wine rack support 40 may have a hollow structure, and the wine rack support may be combined by two housings.

As shown in FIG. 4, according to an embodiment of the present disclosure, the refrigerator may further include a pre-embedded member 50. The pre-embedded member 50 may be disposed at outside of the refrigeration compartment 101 and correspond to the wine rack support 40, and the pre-embedded member 50 may be connected to the wine rack support 40 through a screw penetrating the side wall. Accordingly, the wine rack support 40 may be firmly fixed to the liner 10.

Figure 5:
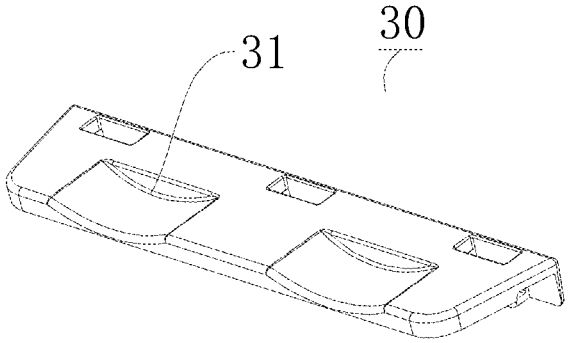
FIG. 5 is a perspective view of an auxiliary bracket for a refrigerator according to an embodiment of the present disclosure.

As shown in FIG. 5, according to an embodiment of the present disclosure, the bottle placing portion 21 is a first recess formed in the wine rack 20, and the auxiliary bracket 30 has a second recess 31 corresponding to the first recess. Accordingly, a wine bottle can be firmly fixed between the wine rack 20 and the auxiliary bracket 30. Furthermore, according to an embodiment of the present disclosure, the auxiliary bracket 30 is detachably connected to the liner 10, so as to facilitate use. For example, the auxiliary bracket 30 may be snapped to the liner 10. At the same time, the auxiliary bracket 30 is a plastic member to make the production cost low.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A refrigerator, comprising:

a liner forming a refrigeration compartment of the refrigerator;

a wine rack having a bottle placing portion and an end being connected to a side wall of the refrigeration compartment and pivoting about an axis in an up-down direction, wherein the wine rack is capable of shifting between a first position where the wine rack abuts against the side wall and a second position where the wine rack is perpendicular to the side wall;

an auxiliary bracket being connected to a rear side wall of the refrigeration compartment and opposite to the bottle placing portion;

a wine rack support, wherein the wine rack support is disposed to the side wall, an upper end face of the wine rack support is provided with a first shaft hole, a lower end face of the wine rack support is provided with a second shaft hole corresponding to the first shaft hole, the wine rack is made of a bended steel wire, and the end of the wine rack is provided with a first rotating shaft fitted with the first shaft hole and a second rotating shaft fitted with the second shaft hole; and a pre-embedded member disposed at outside of the refrigeration compartment and corresponding to the wine rack support, and the pre-embedded member being connected to the wine rack support through a screw penetrating the side wall.

2. The refrigerator according to claim 1, wherein the upper end face of the wine rack support is provided with a limiting member, and the limiting member comprises a transversal limiting portion located in front of the first shaft hole and a longitudinal limiting portion extending backwards from an upper portion of the transversal limiting portion at a predetermined distance.

3. The refrigerator according to claim 2, wherein the transversal limiting portion and the longitudinal limiting portion are integrated.

4. The refrigerator according to claim 1, wherein the wine rack support has a hollow structure.

5. The refrigerator according to claim 1, wherein the bottle placing portion is a first recess formed in the wine rack, and the auxiliary bracket has a second recess corresponding to the first recess.

6. The refrigerator according to claim 1, wherein the auxiliary bracket is detachably connected to the liner.

7. The refrigerator according to claim 1, wherein the auxiliary bracket is snapped to the liner.

8. The refrigerator according to claim 1, wherein the auxiliary bracket is a plastic member.

9. The refrigerator according to claim 2, wherein the wine rack support has a hollow structure.

10. The refrigerator according to claim 3, wherein the wine rack support has a hollow structure.

11. The refrigerator according to claim 2, wherein the bottle placing portion is a first recess formed in the wine rack, and the auxiliary bracket has a second recess corresponding to the first recess.

12. The refrigerator according to claim 3, wherein the bottle placing portion is a first recess formed in the wine rack, and the auxiliary bracket has a second recess corresponding to the first recess.

* * * * *